US011332876B2

(12) United States Patent
Carpenter

(10) Patent No.: US 11,332,876 B2
(45) **Date of Patent: *May 17, 2022**

(54) FABRIC TREATING APPLIANCE COMPRISING A SCRUBBING TOOL

(71) Applicant: WHIRLPOOL CORPORATION, Benton Harbor, MI (US)

(72) Inventor: Scott E. Carpenter, Wanatah, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 226 days.

This patent is subject to a terminal disclaimer.

(21) Appl. No.: 16/724,213

(22) Filed: Dec. 21, 2019

(65) Prior Publication Data

US 2020/0123696 A1 Apr. 23, 2020

Related U.S. Application Data

(63) Continuation of application No. 16/263,863, filed on Jan. 31, 2019, now Pat. No. 10,544,538, which is a (Continued)

(51) Int. Cl.
*D06F 39/12* (2006.01)
*A46B 5/02* (2006.01)
(Continued)

(52) U.S. Cl.
CPC ..... *D06F 39/12* (2013.01); *A46B 5/02* (2013.01); *A46B 11/002* (2013.01);
(Continued)

(58) Field of Classification Search
CPC ..... D06F 39/14; D06F 39/12; D06F 39/08; D06F 39/02; D06F 1/04; D06F 29/00; D06F 17/10; D06F 37/12; D06F 43/002; D06F 3/04; D06F 23/04; A46B 11/0013; A46B 2200/3033; A46B 11/0041; A46B 7/04; A46B 11/0062; A46B 11/002; A46B 2200/3053; A46B 5/02; B08B 3/006
USPC ..... 68/13 R, 3 R, 233, 196, 14, 17 R, 207, 68/23.3, 208, 23.5, 38, 235 D, 5 A, 12.18; 312/228, 328, 290, 242
See application file for complete search history.

(56) References Cited

U.S. PATENT DOCUMENTS 806,680 A * 12/1905 Kottmeyer ..... D06F 1/04 68/233
1,373,980 A 4/1921 Shults
(Continued)

FOREIGN PATENT DOCUMENTS

EP 1508284 A1 2/2005
GB 2478935 A 9/2011

*Primary Examiner* — Michael E Barr
*Assistant Examiner* — Thomas Bucci
(74) *Attorney, Agent, or Firm* — McGarry Bair PC

(57) ABSTRACT

A fabric treating appliance includes a cabinet defining an interior and having a top wall defining an access opening. A cover is provided that is movable relative to the cabinet between an open position and a closed position to selectively close the access opening. A tub is located within the interior and includes and open top aligned with the access opening. A rotatable basket is located within the tub and has a loading opening aligned with the open top and the access opening. A top wall extends between the cabinet and the tub.

20 Claims, 8 Drawing Sheets

Related U.S. Application Data continuation of application No. 15/602,169, filed on May 23, 2017, now Pat. No. 10,233,587.

(51) Int. Cl.

| | |
|---|---|
| ***D06F 17/10*** | (2006.01) |
| ***D06F 37/12*** | (2006.01) |
| ***D06F 43/00*** | (2006.01) |
| ***A46B 11/00*** | (2006.01) |
| *D06F 3/04* | (2006.01) |
| *D06F 39/02* | (2006.01) |
| *D06F 23/04* | (2006.01) |

(52) U.S. Cl.

CPC ..... *A46B 11/0041* (2013.01); *D06F 17/10* (2013.01); *D06F 37/12* (2013.01); *D06F 43/002* (2013.01); *A46B 2200/3053* (2013.01); *D06F 3/04* (2013.01); *D06F 23/04* (2013.01); *D06F 39/02* (2013.01)

(56) References Cited

U.S. PATENT DOCUMENTS

| | | | | | |
|---|---|---|---|---|---|
| 1,462,573 | A | | 7/1923 | Hagaman | |
| 3,026,699 | A | * | 3/1962 | Rhodes | D06F 39/085 68/12.19 |
| 3,039,286 | A | * | 6/1962 | Shelton | D06F 29/00 68/208 |
| 3,209,560 | A | * | 10/1965 | Shelton | D06F 13/00 68/4 |
| 3,490,254 | A | * | 1/1970 | Mason | D06F 13/00 68/14 |
| 3,890,988 | A | * | 6/1975 | Lee | B08B 3/006 134/111 |
| 4,051,858 | A | | 10/1977 | Mele | |
| 4,226,548 | A | * | 10/1980 | Reith | B08B 3/006 134/111 |
| 4,437,714 | A | | 3/1984 | Struck | |
| 4,462,415 | A | | 7/1984 | Otzen | |
| 4,955,746 | A | | 9/1990 | Craigmile | |
| 5,253,493 | A | * | 10/1993 | Ohashi | D06F 39/14 68/4 |
| 5,872,090 | A | * | 2/1999 | You | D06F 43/00 510/284 |
| 6,036,391 | A | * | 3/2000 | Holliday | A46B 11/0013 401/184 |
| 6,161,401 | A | | 12/2000 | Wunderlich et al. | |
| 6,171,346 | B1 | * | 1/2001 | Yeazell | A47L 25/08 510/297 |
| 6,216,498 | B1 | | 4/2001 | Wright et al. | |
| 6,233,771 | B1 | * | 5/2001 | Hortel | A46B 5/02 15/143.1 |
| 6,327,729 | B1 | | 12/2001 | Wunderlich et al. | |
| 6,353,954 | B1 | * | 3/2002 | Dunsbergen | D06F 37/28 8/158 |
| 7,296,443 | B2 | * | 11/2007 | Usherovich | D06F 39/14 68/3 R |
| 7,461,993 | B1 | | 12/2008 | Sampaio | |
| D689,700 | S | | 9/2013 | Lee et al. | |
| 9,228,288 | B2 | | 1/2016 | Davis et al. | |
| 9,315,934 | B2 | | 4/2016 | Kim et al. | |
| 10,233,587 | B2 | * | 3/2019 | Carpenter | D06F 43/002 |
| 10,544,538 | B2 | * | 1/2020 | Carpenter | D06F 39/12 |
| 2005/0025561 | A1 | | 2/2005 | Larsen | |
| 2005/0072194 | A1 | * | 4/2005 | Ryohke | D06F 34/20 68/3 R |
| 2006/0110205 | A1 | | 5/2006 | Glynn et al. | |
| 2006/0156763 | A1 | * | 7/2006 | Vecchi | D06F 34/14 68/3 SS |
| 2009/0126091 | A1 | * | 5/2009 | Buehler | E03C 1/264 4/295 |
| 2011/0179587 | A1 | * | 7/2011 | Chawla | A46B 11/0013 8/137 |
| 2012/0138088 | A1 | | 6/2012 | Tumale | |
| 2012/0324655 | A1 | * | 12/2012 | Chawla | C11D 17/049 8/137 |
| 2013/0340178 | A1 | | 12/2013 | Riesenberg et al. | |
| 2015/0247276 | A1 | * | 9/2015 | Kim | D06F 31/00 68/27 |
| 2015/0252508 | A1 | * | 9/2015 | Kim | D06F 31/00 68/27 |
| 2015/0299927 | A1 | * | 10/2015 | Kim | D06F 31/00 68/27 |
| 2016/0102425 | A1 | * | 4/2016 | Scheckelhoff | D06F 29/00 68/13 R |

* cited by examiner

FABRIC TREATING APPLIANCE COMPRISING A SCRUBBING TOOL

CROSS-REFERENCE TO RELATED APPLICATIONS

This application is a continuation of U.S. patent application Ser. No. 16/263,863, filed Jan. 31, 2019, now U.S. Pat. No. 10,544,538, issued Jan. 28, 2020, which is a continuation of U.S. patent application Ser. No. 15/602,169, filed May 23, 2017, now U.S. Pat. No. 10,233,587, issued Mar. 19, 2019, both of which are incorporated herein by reference in their entirety.

BACKGROUND OF THE INVENTION

Fabric treating appliances typically operate to clean fabric by placing the fabric in contact with cleaning fluid such as soapy water, and providing relative motion between the fabric and the fluid. Commonly a fabric mover such as an agitator provides mechanical energy to a load of fabric immersed in the cleaning fluid by agitating the fabric load in a manner that both jostles the fabric in the fluid and circulates the fluid through the fabric. A fabric treating appliance for home use can perform a select programmed series of operations on fabric placed in a basket or drum located within the interior of the machine. However, it can occur that none of a selection of preprogrammed wash cycles is thought by the washing machine operator to be sufficient to fully remove certain stains on the fabric being laundered. The operator can choose to address such stains manually before adding the stained fabric to the fabric load.

SUMMARY

The disclosure relates to a fabric treating appliance comprising: a cabinet defining an interior and having a top wall defining an access opening; a cover movable relative to the cabinet between opened and closed positions to selectively close the access opening; a tub located within the interior and having an open top aligned with the access opening; a rotatable basket located within the tub and having a loading opening aligned with the open top and the access opening; a top wall extending between at least one of the cabinet and the tub; a scrubbing tool seat recessed in the top wall; and a scrubbing tool comprising a gripper portion and a set of bristles mounted on the tool opposite the gripper portion, with the scrubbing tool removably disposed in the scrubbing tool seat such that the gripper portion is oriented up and the height of the gripper portion is such that at least a portion of the gripper portion extends above the top wall.

In another aspect, the disclosure relates to a fabric treating appliance comprising: a cabinet defining an interior and having a top wall defining an access opening; a cover movable relative to the cabinet between opened and closed positions to selectively close the access opening; a tub located within the interior and having an open top aligned with the access opening; a rotatable basket located within the tub and having a loading opening aligned with the open top and the access opening; a top wall extending between at least one of the cabinet and the tub; a scrubbing tool seat recessed in the top wall and comprising an aperture in the seat fluidly connected to the tub to define a drain in fluid communication with the tub; and a scrubbing tool removably disposed in the scrubbing tool seat, wherein excess liquid from the scrubbing tool can be drained through the aperture and into the tub, and the scrubbing tool having a gripper portion oriented up relative to the seat and the height of the gripper portion is such that the at least a portion of the gripper portion extends above the top wall.

DESCRIPTION

Figure 1:
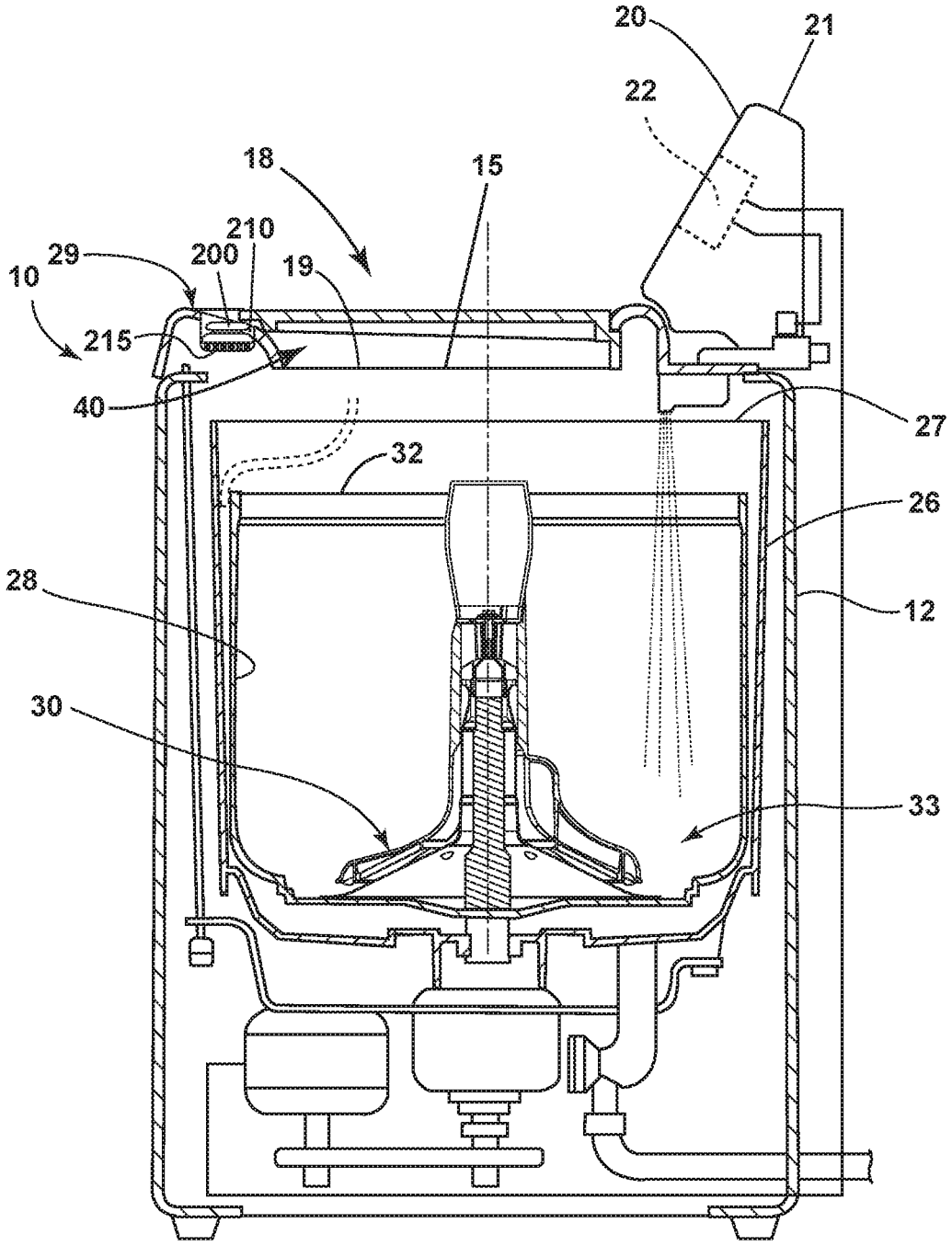
FIG. 1 is a schematic sectional view of an exemplary embodiment of fabric treating appliance in the form of a washing machine.

FIG. 1 is a schematic view of an exemplary embodiment of a fabric treating appliance in the form of a vertical axis washing machine 10. The washing machine 10 can include a cabinet 12 defining an interior for housing the operational parts of the washing machine, together with a hinged cover 18. Housed within the cabinet 12 is a wash tub 26, a basket 28, and an agitator assembly 30. The tub 26 holds the wash liquid that is used in the operation of the washing machine 10. The tub 26 is located within the interior of the cabinet 12 and has an open top 27. The basket 28 holds the fabric during operation of the washing machine 10. The basket 28 is located within the tub 26 and has a loading opening 32 aligned with the open top 27 of the tub 26. The basket 28 can be thought of as defining a treating chamber 33 in which the fabric is treated. The cabinet 12 can also have a top wall 19 comprising a shroud 29 provided at the top of the cabinet 12 and defining an access opening 15, which aligns with both the open top 27 of the tub 26 and the loading opening 32 of the basket 28, which items of clothing or other fabric can pass when placing the fabric items into the basket 28 for washing. The shroud 29 can curve downwards toward the treating chamber 33 to direct fabric items into the basket 28. The shroud 29 can overlie a portion of the tub 26 and basket 28 such that the fabric items do not fall between the basket 28 and the tub 26. The top wall 19 and shroud 29 can also have a recess defining a scrubbing tool seat 210 where a scrubbing tool 200 can be removably disposed in the seat 210. The scrubbing tool seat 210 can have a drain 215 that is fluidly connected to the tub 26. A gap 40 can also formed between the shroud 29 and the hinged cover 18. A console 21 having control panel 20 which includes the operating controls 22 for the washer is illustrated on the upper, rear of the cabinet 12, but can be located elsewhere.

Figure 2:
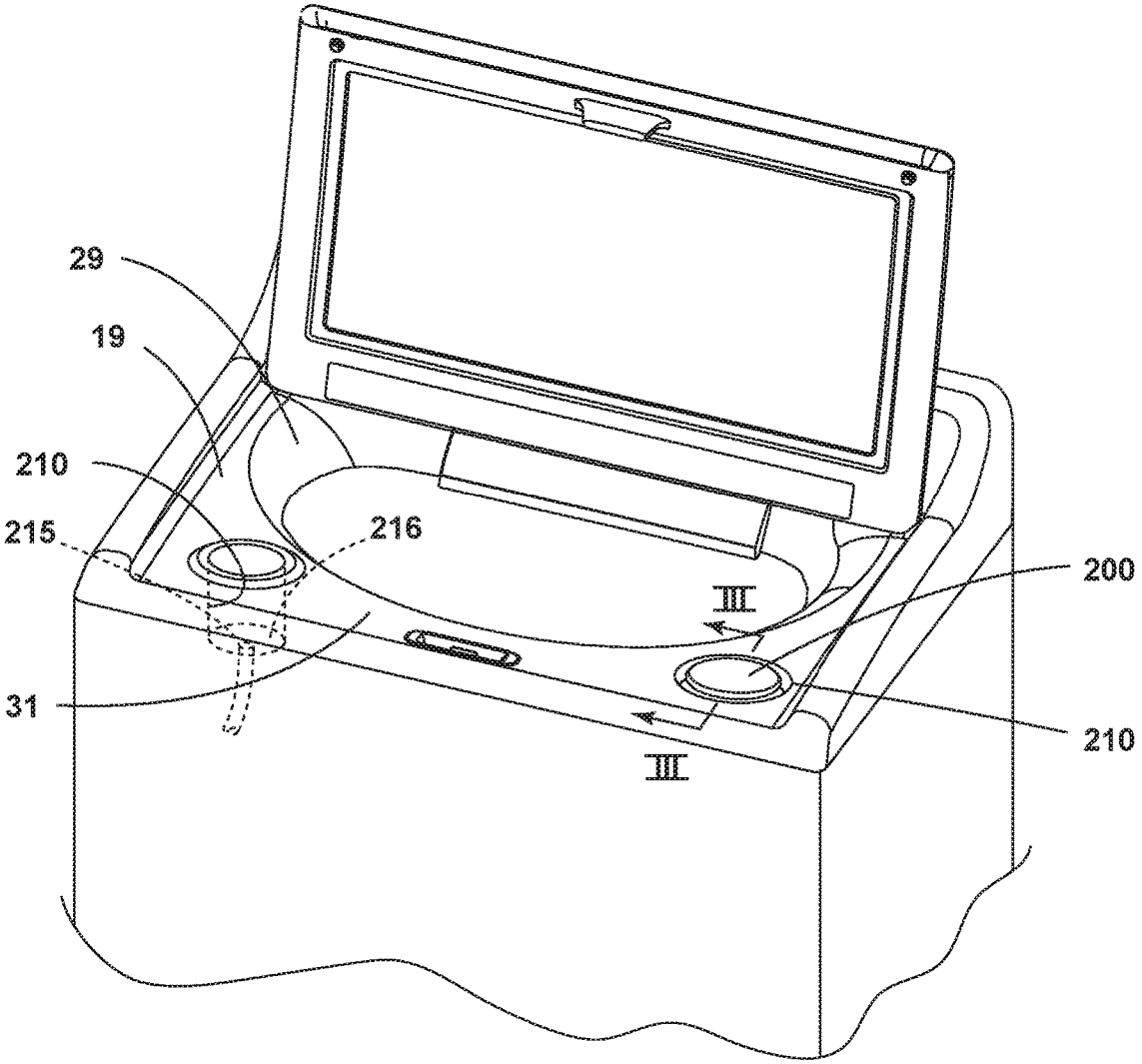
FIG. 2 is a perspective view of the top of an exemplary embodiment of the washing machine of FIG. 1 with a scrubbing tool housed in a scrubbing tool seat.

FIG. 2 is a perspective view of the top of the fabric treating appliance 10 with the hinged cover 18 shown in an open condition to illustrate a scrubbing tool 200 and a scrubbing tool seat 210 in which the scrubbing tool 200 can be stored. The scrubbing tool 200 and scrubbing tool seat 210 can be located in the top wall 19 or the shroud 29 of cabinet 12 and there can be multiple scrubbing tool seat 210 locations for user convenience. While FIG. 2 depicts two scrubbing tool seats 210, one on each side of the wash tub 28 and toward the front of the cabinet 12, the invention is not limited to this arrangement. One scrubbing tool seat 210 is sufficient for housing a scrubbing tool 200 and its location in the top wall 19 or shroud 29 is not limited, although in an exemplary embodiment a scrubbing tool seat 210 can be located in a front portion of the shroud 29 or top wall 19 for easy accessibility by a user.

The recessed scrubbing tool seat 210 can have a drain 215 comprising one or more openings to allow residual liquid in the scrubbing tool seat 210 to drain into the tub 26 or wash basket 28. The drain 215 can be fluidly connected to the tub as it is positioned over and above the tub 26 thereby allowing any excess liquid to gravity feed directly into the tub 26 (as shown in FIG. 1). In this embodiment, the floor 216 of the scrubbing tool seat 210 can be slanted toward the drain 215 to allow excess liquid to easily drain from the scrubbing tool seat 210. Alternatively, and as illustrated in FIG. 2, the drain 215 can be fluidly connected to the tub 26 via mechanical connections and couplings. In this embodiment, the scrubbing tool seat 210 can be configured to act as a reservoir for dispensing detergent, softener, or other fabric treating liquid during a wash cycle.

A scrubbing surface 31 can be provided on the top wall 19 or shroud 29 of the cabinet 12. The scrubbing surface 31 can include a smooth or textured area for supporting material being pretreated. The scrubbing surface 31 can also be located in an area adjacent to or contiguous to the scrubbing tool seat 210. The scrubbing surface 31 can be configured to allow for the passing of excess pretreating liquid through the scrubbing surface during use. For example, the scrubbing surface 31 can include grooves, channels, or perforations through which the pretreating liquid can drain out (not shown). Such perforations can comprise a plurality of small holes, thin slots, or the like, in any desired arrangement. The scrubbing surface 31 and draining elements can be arranged to drain the excess pretreating liquid into the treating chamber 33 or the scrubbing tool seat 210. The scrubbing surface can also comprise perforated material such as mesh or polymeric materials, or other material that is conducive to allowing a liquid to pass through. The perforated material or mesh can be made of plastic, metal or other suitable material.

Figure 3A:
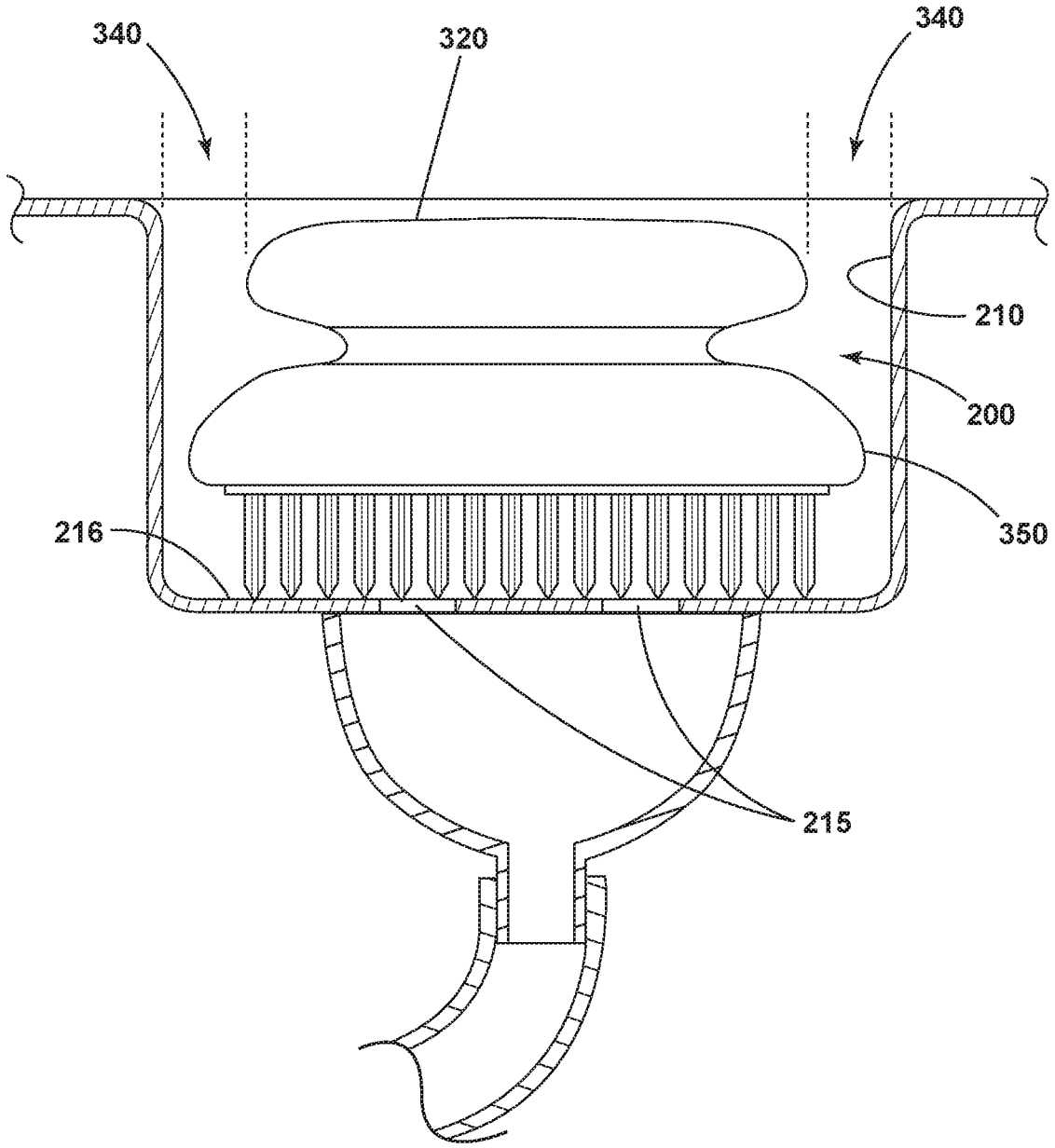
FIG. 3A is a cross sectional view taken along line 3-3 of FIG. 2 of a scrubbing tool seat and scrubbing tool housed in the seat.

The details of the scrubbing tool 200 and scrubbing tool seat 210 are best seen with respect to FIG. 3A, which illustrates a cross-sectional view of the scrubbing tool seat 210 with scrubbing tool 200 placed therein. It should be recognized that the scrubbing tool 200 could be virtually any design and height that conforms to the relative size of the scrubbing tool seat 210. The scrubbing tool's 200 height could extend above the height of the scrubbing tool seat 210, or conversely, the scrubbing tool's 200 height might not extend to the height of the scrubbing tool seat 210 in an at rest position. In an exemplary embodiment, the height of the scrubbing tool 200 is generally intended to be flush with or slightly extending or protruding above the top of the scrubbing tool seat 210 in an at rest position. This configuration allows the hinged cover 18 to move to a fully closed position while the scrubbing tool 200 rests in the scrubbing tool seat 210. This configuration also allows a user access to the bristles 410 of the scrubbing tool 200 for pretreating purposes when the cover 18 is in an open position and the scrubbing tool 200 is stored in a bristles-up orientation. In an alternate configuration wherein a gap 40 is present between the top of shroud 29 and the bottom of hinged cover 18, the height of the scrubbing tool 200 could be designed to extend above or protrude above the scrubbing tool seat 210 while still allowing the hinged cover 18 to move to a fully closed position.

Figure 3B:
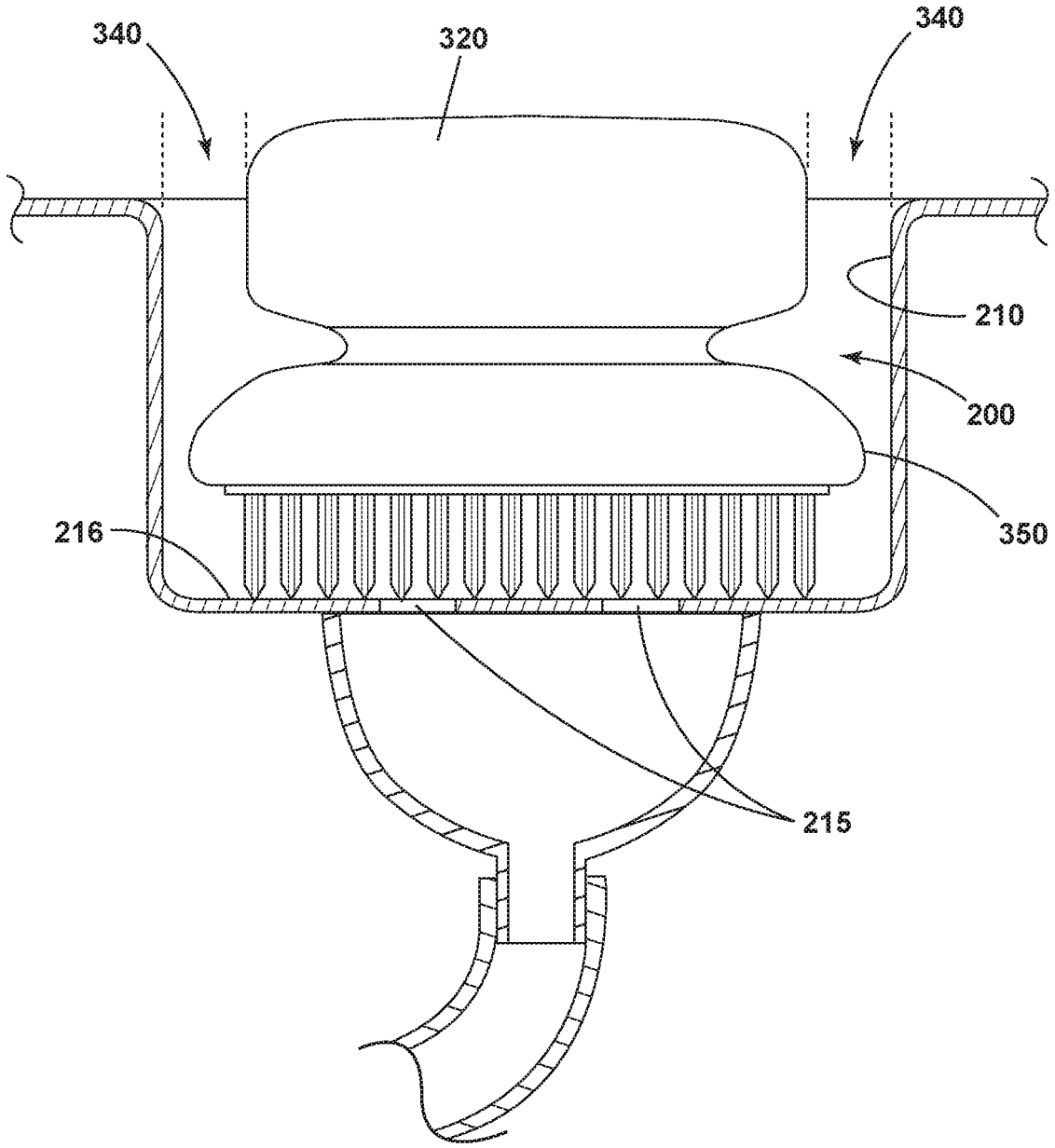
FIG. 3B is a view similar to FIG. 3A and illustrating an alternative scrubbing tool housed in the seat.

The spacing between the inner diameter of the seat 210 and the top or gripper portion 320 of the scrubbing tool 200 can form a gap 340, which is sufficient to permit a user to access or grab the gripper portion 320 of scrubbing tool 200 with their fingers. In a protruding configuration, shown in FIG. 3B, wherein the gripper portion 320 of the scrubbing tool 200 extends above the scrubbing tool seat 210, the scrubbing tool 200 can be grasped without a finger gap 340 being necessary to access the gripper portion 320 of the scrubbing tool 200. In the protruding configuration, the bottom portion 350 of the scrubbing tool 200 can have a complementary shape to the scrubbing tool seat 210, but the gripper portion 320 of the scrubbing tool 200 could have any shape since it is not disposed within the scrubbing tool seat 210.

Figure 4:
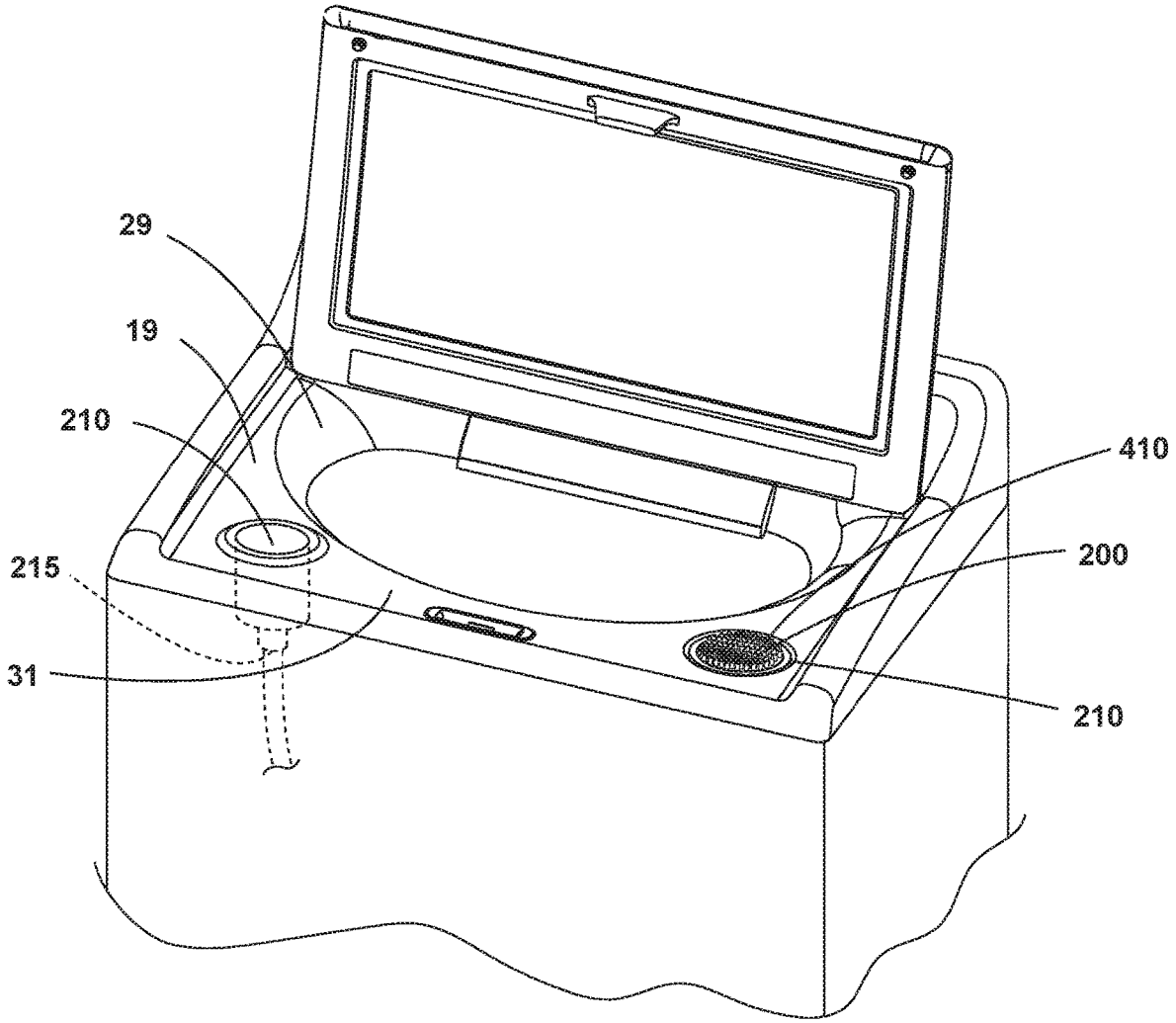
FIG. 4 is a perspective view of the top of an exemplary embodiment of the washing machine of FIG. 1 with a scrubbing tool housed bristles up in a scrubbing tool seat.

As shown in FIG. 4, the scrubbing tool 200 can be removably inserted into the scrubbing tool seat 210 in a bristles-up orientation as compared to the bristles-down orientation of FIG. 2. The scrubbing tool 200 can be shaped relative to the scrubbing tool seat 210 such that either orientation is possible as is a matter of user preference.

Figure 5:
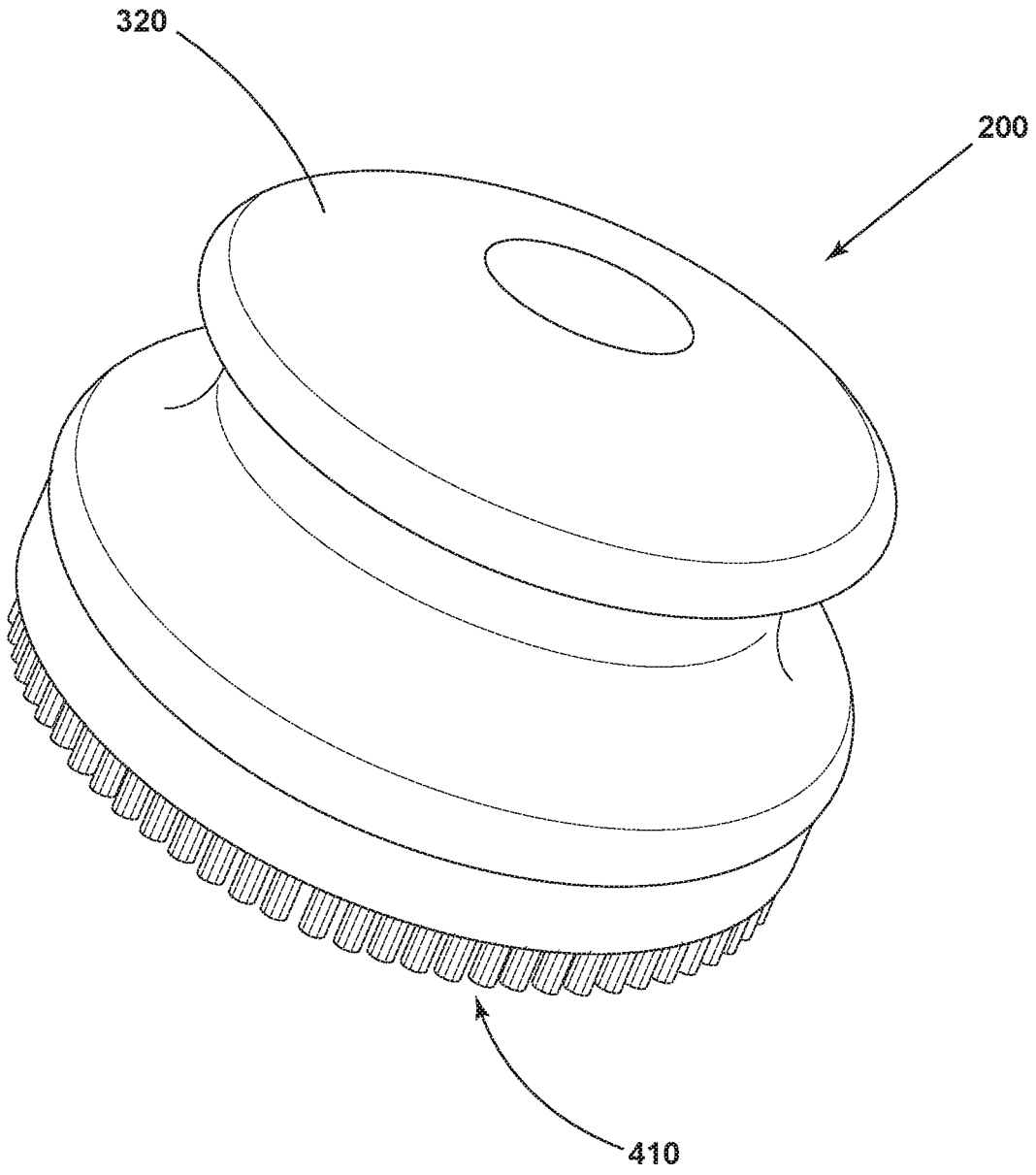
FIG. 5 is a perspective view of a non-dispensing scrubbing tool.

FIG. 5 is a perspective view of scrubbing tool 200. The scrubbing tool 200 comprises a gripper portion 320 and a set of bristles 410 mounted on the scrubbing tool 200 opposite the gripper portion 320. In an exemplary operation, the scrubbing tool 200 is non-dispensing and can be used by applying pretreating liquid directly to the stain and/or to the bristles 410, and brushing the stained material against the bristles 410, or brushing the tool 200 with bristles 410 against the stained material. In this embodiment, the scrubbing tool 200 need not comprise a reservoir or dispenser.

Figure 6:
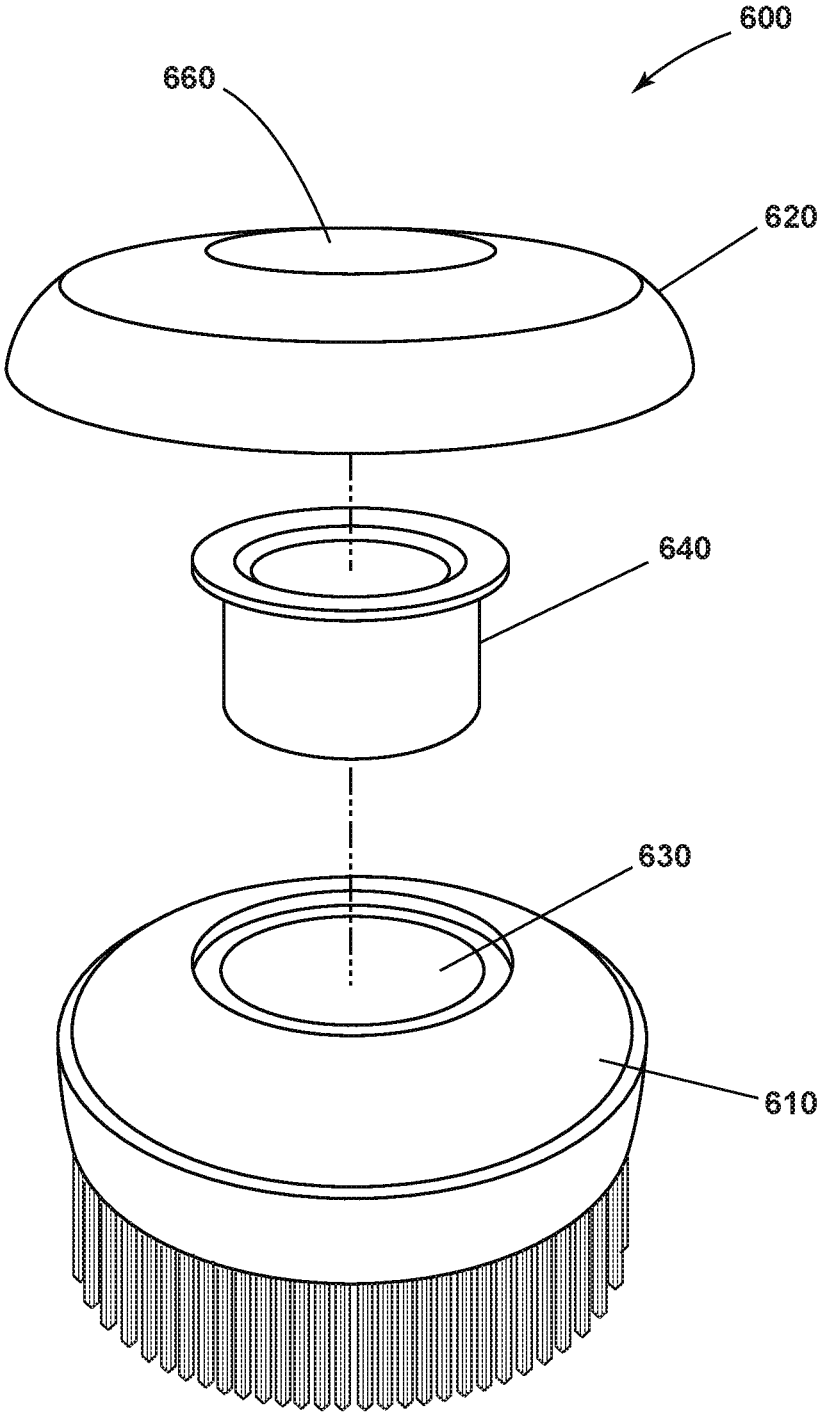
FIG. 6 is an exploded, perspective view of a dispensing scrubbing tool having a reservoir.

FIG. 6 is a perspective view of another exemplary embodiment of a scrubbing tool 600. The scrubbing tool 600 is shown exploded and its constituent parts can be seen. The scrubbing tool 600 comprises a base 610 and a cap 620. Complementary elements can be included to removably secure the cap 620 to the base 610. For example, the base 610 and cap 620 can be configured with threads that can be screwed together, or edges that can snap together, although other coupling elements or methods can be used. As shown in FIG. 6, cap 620 has been removed from base 610 to reveal a reservoir 630 formed in the base 610. In one example, the reservoir 630 is at least partially located in the base 610 and shaped to receive a replaceable container 640 of pretreating liquid or a chemistry pod. The container 640 can be inserted into the reservoir 630 and opened as the cap 620 is coupled to the base 610. Alternatively, the reservoir 630 can be filled with pretreating liquid, for example, by opening the scrubbing tool 600 and pouring liquid directly into the reservoir 630. In these embodiments, the scrubbing tool 600 can have a dispenser (not shown) that is operated by pushing on a compressible element 660 that activates a valve or conveys pressure to a pump fluidly coupled to the reservoir 630 to dispense the liquid in the reservoir 630. While the compressible element 660 is shown on the cap 620, other types and/or arrangements of dispensers can alternatively be used and incorporated into the scrubbing tool 600.

It is noted that the scrubbing tool 600 illustrated in FIG. 6 is merely an illustrative example of a scrubbing tool 600 that can have a refillable reservoir for holding and dispensing pretreating liquid. Alternatively, the body of the scrubbing tool 200 as illustrated in FIG. 5 can comprise a single piece with no reservoir, and can be used after manually applying the pretreatment liquid to the bristles 410, to the stain, or both. Other configurations and/or arrangements can also or alternatively be used.

Figure 7A:
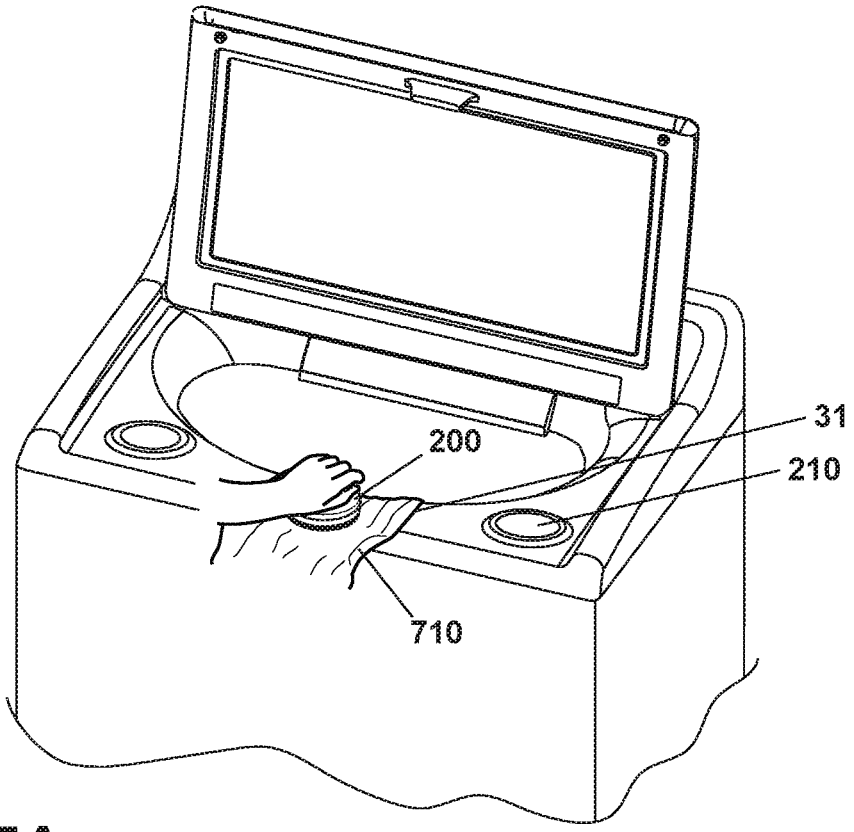
FIG. 7A is a perspective view depicting exemplary use of a scrubbing tool.

FIG. 7A illustrates an example scrubbing tool 200 in use. In this example, a user can place a stained fabric 710 to be treated on the scrubbing surface 31 and use any method of manual force to treat the stain on the fabric 710. A user can apply a pretreating liquid directly to a stained fabric 710 or a pretreating liquid can be dispensed by the scrubbing tool 600 onto the stained fabric 710. In either case, the user can manually scrub the fabric 710 with the scrubbing tool 200. If the scrubbing tool 200 is removed from the scrubbing tool seat 210 for use, the scrubbing tool 200 can be returned to the scrubbing tool seat 210 upon completion of stain pretreatment.

Figure 7B:
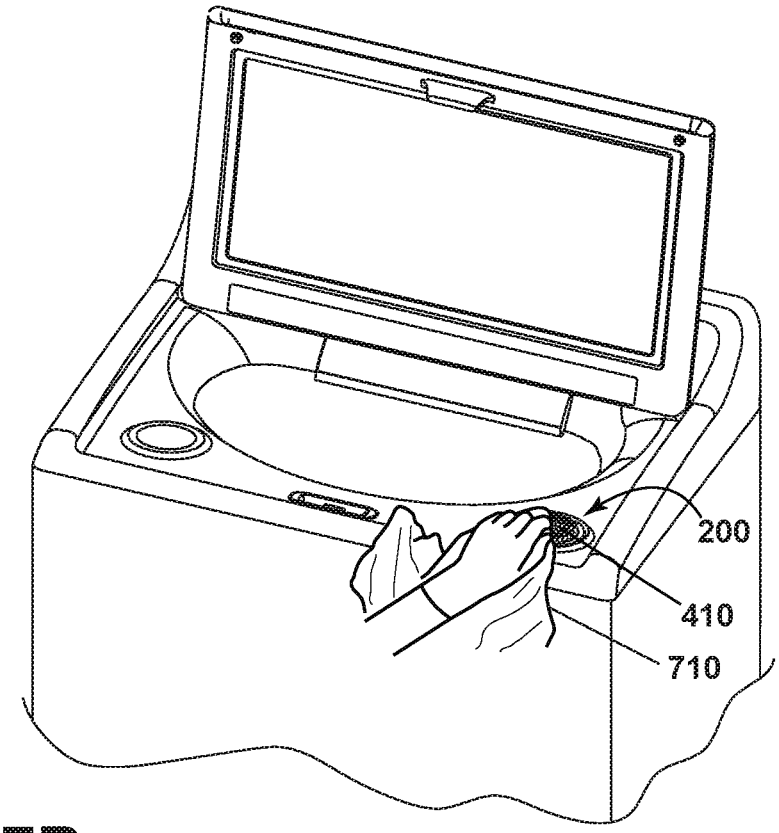
FIG. 7B is a perspective view depicting an alternate use of a scrubbing tool.

In the example illustrated in FIG. 7B, the scrubbing tool 200 need not be removed from the scrubbing tool seat 210 during use. Instead, a piece of stained fabric 710 being pretreated can be manually brushed across the bristles 410 using a sliding, circular, or other motion after applying pretreating liquid to one or both of the stain and the bristles 410.

Although the invention has been described and illustrated in exemplary forms with a certain degree of particularity, it is noted that the description and illustrations have been made by way of example only. Numerous changes in the details of construction, combination, and arrangement of parts and steps can be made without deviating from the scope of the invention. Accordingly, such changes are understood to be inherent in the disclosure. The invention is not limited except by the appended claims and the elements explicitly recited therein. The scope of the claims should be construed as broadly as the prior art will permit. It should also be noted that all elements of all of the claims can be combined with each other in any possible combination, even if the combinations have not been expressly recited or claimed.

What is claimed is:

1. A fabric treating appliance comprising:

a cabinet defining an interior and having a top wall defining an access opening;

a cover movable relative to the cabinet between opened and closed positions to selectively close the access opening;

a tub located within the interior and having an open top aligned with the access opening;

a rotatable basket located within the tub and having a loading opening aligned with the open top and the access opening;

a top wall extending between at least one of the cabinet and the tub;

a scrubbing tool seat recessed in the top wall; and a scrubbing tool comprising a gripper portion and a set of bristles mounted on the tool opposite the gripper portion, with the scrubbing tool removably disposed in the scrubbing tool seat such that the gripper portion is oriented up and a height of the gripper portion is such that at least a portion of the gripper portion extends above the top wall.

2. The fabric treating appliance of claim 1 wherein when the cover is in the closed position, the cover overlies the gripper portion.

3. The fabric treating appliance of claim 2 wherein the cover does not contact the gripper portion in the closed position.

4. The fabric treating appliance of claim 1 wherein at least a portion of the scrubbing tool and the scrubbing tool seat are complementary in shape.

5. The fabric treating appliance of claim 1 wherein the top wall comprises a shroud and the scrubbing tool seat is located in the shroud.

6. The fabric treating appliance of claim 5 wherein at least a portion of the gripper portion extends above the shroud.

7. The fabric treating appliance of claim 1 wherein the seat comprises an aperture fluidly coupled to the tub for allowing excess liquid from the scrubbing tool to be drained through the aperture and into the tub.

8. The fabric treating appliance of claim 1 wherein the scrubbing tool comprises a cap portion removably coupled to a base portion, and a reservoir is at least partially located within the base portion.

9. The fabric treating appliance of claim 8 wherein the scrubbing tool comprises a compressible element.

10. The fabric treating appliance of claim 8 wherein the reservoir is configured to receive a removable chemistry pod.

11. The fabric treating appliance of claim 1 wherein the scrubbing tool comprises a refillable liquid reservoir.

12. The fabric treating appliance of claim 1 wherein a gap is maintained between the scrubbing tool seat and the gripper portion when the scrubbing tool is disposed in the scrubbing tool seat.

13. The fabric treating appliance of claim 1 wherein the scrubbing tool seat is located along a front portion of the top wall.

14. The fabric treating appliance of claim 1 wherein the top wall further comprises a scrubbing surface.

15. The fabric treating appliance of claim 14, wherein the scrubbing surface is spaced adjacent from the scrubbing tool seat.

16. The fabric treating appliance of claim 14, wherein the scrubbing surface is contiguous with at least a portion of an edge of the scrubbing tool seat.

17. The fabric treating appliance of claim 1 wherein all of the gripper portion lies above the top wall.

18. A fabric treating appliance comprising:

a cabinet defining an interior and having a top wall defining an access opening;

a cover movable relative to the cabinet between opened and closed positions to selectively close the access opening;

a tub located within the interior and having an open top aligned with the access opening;

a rotatable basket located within the tub and having a loading opening aligned with the open top and the access opening;

a top wall extending between at least one of the cabinet and the tub;

a scrubbing tool seat recessed in the top wall and comprising an aperture in the seat fluidly connected to the tub to define a drain in fluid communication with the tub; and a scrubbing tool removably disposed in the scrubbing tool seat, wherein excess liquid from the scrubbing tool can be drained through the aperture and into the tub, and the scrubbing tool having a gripper portion oriented up relative to the seat and a height of the gripper portion is such that the at least a portion of the gripper portion extends above the top wall.

19. The fabric treating appliance of claim 18 wherein a gap is maintained between the scrubbing tool seat and the gripper portion when the scrubbing tool is disposed in the scrubbing tool seat.

20. The fabric treating appliance of claim 19 wherein all of the gripper portion lies above the top wall.

* * * * *